US011780483B2

(12) United States Patent
Subrahmaniyan et al.

(10) Patent No.: US 11,780,483 B2
(45) Date of Patent: Oct. 10, 2023

(54) ELECTRONIC JOB AID SYSTEM FOR OPERATOR OF A VEHICLE SYSTEM

(71) Applicant: GE Global Sourcing LLC, Norwalk, CT (US)

(72) Inventors: Neeraja Subrahmaniyan, Niskayuna, NY (US); James D. Brooks, Schenectady, NY (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 1127 days.

(21) Appl. No.: 16/418,599

(22) Filed: May 21, 2019

(65) Prior Publication Data

US 2019/0359239 A1 Nov. 28, 2019

Related U.S. Application Data

(60) Provisional application No. 62/675,017, filed on May 22, 2018.

(51) Int. Cl.

| | |
|---|---|
| ***B61L 27/20*** | (2022.01) |
| ***B61L 25/02*** | (2006.01) |
| ***B61L 27/70*** | (2022.01) |

(52) U.S. Cl.

CPC ..... *B61L 27/20* (2022.01); *B61L 25/021* (2013.01); *B61L 25/025* (2013.01); *B61L 27/70* (2022.01); *B61L 2201/00* (2013.01); *B61L 2205/00* (2013.01)

(58) Field of Classification Search

None

See application file for complete search history.

(56) References Cited

U.S. PATENT DOCUMENTS

| | | | | |
|---|---|---|---|---|
| 4,525,011 | A * | 6/1985 | Wilson | B60T 7/128 303/19 |
| 5,267,147 | A | 11/1993 | Harshaw et al. | |
| 5,452,870 | A | 9/1995 | Heggestad | |
| 5,454,074 | A | 9/1995 | Hartel et al. | |
| 5,522,026 | A | 5/1996 | Records et al. | |
| 6,262,720 | B1 | 7/2001 | Jeffrey et al. | |
| 6,731,925 | B2 | 5/2004 | Naboulsi | |

(Continued)

OTHER PUBLICATIONS

Oman et al. "Locomotive In-Cab Alerter Technology Assessment" Locomotive Alerter Technology—MVL Publication 07.30; 2007 (29 pages).

(Continued)

*Primary Examiner* — Peter D Nolan
*Assistant Examiner* — Michael F Whalen
(74) *Attorney, Agent, or Firm* — The Small Patent Law Group LLC; Christopher R. Carroll

(57) ABSTRACT

A job aid system and method determine conditions in which a vehicle system is operating or will operate during movement of the vehicle system along one or more routes. A context-sensitive action checklist is selected or generated based on one or more of the conditions. Input from the operator of the vehicle system is received in response to one or more action items in the context-sensitive action checklist that is presented to the operator. An alertness level of the operator is determined based on the input that is received from the operator. One or more alerting actions can be implemented to increase the alertness level of the operator.

20 Claims, 10 Drawing Sheets

(56) References Cited

U.S. PATENT DOCUMENTS

| | | | | |
|---|---|---|---|---|
| 6,753,891 | B1 | 6/2004 | Chohan et al. | |
| 7,398,140 | B2 | 7/2008 | Kemnwein et al. | |
| 7,956,757 | B2 * | 6/2011 | Kumar | G08B 21/06 340/576 |
| 8,188,870 | B2 * | 5/2012 | Kumar | G08B 21/06 340/576 |
| 8,301,108 | B2 | 10/2012 | Naboulsi | |
| 8,736,464 | B1 | 5/2014 | Downs Mullen | |
| 8,866,623 | B2 | 10/2014 | Sharon | |
| 9,047,170 | B2 | 6/2015 | Naboulsi | |
| 9,233,696 | B2 | 1/2016 | Kumar et al. | |
| 9,428,202 | B2 | 8/2016 | Perras et al. | |
| 9,524,034 | B2 | 12/2016 | Naboulsi | |
| 9,713,994 | B2 | 7/2017 | Nabousli | |
| 9,855,961 | B2 | 1/2018 | West et al. | |
| 9,908,530 | B1 | 3/2018 | Fields et al. | |
| 10,081,317 | B2 | 9/2018 | Naboulsli | |
| 2003/0096593 | A1 | 5/2003 | Naboulsi | |
| 2003/0096594 | A1 | 5/2003 | Naboulsi | |
| 2004/0209594 | A1 | 10/2004 | Naboulsi | |
| 2007/0150119 | A1 | 6/2007 | Mitchell et al. | |
| 2008/0074247 | A1 | 3/2008 | Plantamura | |
| 2009/0058624 | A1 * | 3/2009 | Kane | B60L 3/02 340/439 |
| 2009/0267777 | A1 * | 10/2009 | Kumar | G08B 21/06 340/576 |
| 2010/0039514 | A1 | 2/2010 | Brand | |
| 2011/0205070 | A1 * | 8/2011 | Kumar | G08B 21/06 340/576 |
| 2012/0092173 | A1 | 4/2012 | Sanchez | |
| 2012/0209468 | A1 | 8/2012 | Thomas | |
| 2013/0124038 | A1 | 5/2013 | Naboulsi | |
| 2015/0277579 | A1 | 10/2015 | Naboulsi | |
| 2016/0300474 | A1 | 10/2016 | Warren et al. | |
| 2017/0182956 | A1 | 6/2017 | Naboulsi | |
| 2017/0197646 | A1 | 7/2017 | Shubs, Jr. et al. | |
| 2017/0267251 | A1 | 9/2017 | Roberts et al. | |
| 2017/0320452 | A1 | 11/2017 | Naboulsi | |
| 2017/0334374 | A1 | 11/2017 | Naboulsi | |
| 2019/0031124 | A1 | 1/2019 | Naboulsi | |
| 2019/0092337 | A1 | 3/2019 | Chua et al. | |
| 2019/0095725 | A1 | 3/2019 | Kalghatgi et al. | |

OTHER PUBLICATIONS

"Electronic Flight Bags (EFBs)" NBAA—National Business Aviation Association; 2018 (3 pages).

"NORAC Operating Rules" Northeast Operating Rules Advisory Committee; 10th Edition; 2011 (154 pages).

"General Code of Operating Rules" General Code of Operating Rules Committee; 6th Edition; 2010 (158 pages).

* cited by examiner

ELECTRONIC JOB AID SYSTEM FOR OPERATOR OF A VEHICLE SYSTEM

CROSS-REFERENCE TO RELATED APPLICATIONS

This application claims priority to U.S. Provisional Application No. 62/675,017, filed 22 May 2018, the entire disclosure of which is incorporated herein by reference.

FIELD

The subject matter described herein relates to vehicle systems.

BACKGROUND

Some types of vehicle systems have been controlled by two or more human operators disposed onboard the vehicle systems. For example, some rail vehicle systems (e.g., trains) have an engineer and at least one conductor onboard. The engineer may primarily control the movement of the vehicle system by changing throttle settings, brake settings, and the like, while the conductor monitors operation of the vehicle system, restrictions on movement of the vehicle system (e.g., track warrants), and the like, to keep the engineer informed of the operation of the vehicle system. For example, the conductor may remind the engineer of upcoming events, double-check compliance of operating rules, checks on the states of wayside signals, handles paperwork and incoming mandatory directives from a dispatcher, and jogs the alertness and vigilance of the engineer on monotonous stretches of a trip of the train.

Some transportation industries are moving toward single crew operation of vehicle systems. For example, some railroad companies have indicated a desire to transition from the multi-crew onboard management of vehicle systems (described above) to fewer crew members onboard the vehicle systems (e.g., a single person onboard a train to control the train). But, reducing the number of crew members onboard a vehicle system runs significant risk. The engineer may not be able to effectively and safely monitor operation of the train while also safely controlling the movement of the train, ensuring that changing movement restrictions are followed, and staying alert.

BRIEF DESCRIPTION

In one embodiment, a method includes determining conditions in which a vehicle system is operating or will operate during movement of the vehicle system along one or more routes, generating or selecting a context-sensitive action checklist based on one or more of the conditions in which the vehicle system is operating or will operate, presenting the context-sensitive action checklist to an operator of the vehicle system during the movement of the vehicle system, receiving input from the operator of the vehicle system during the movement of the vehicle system and in response to one or more action items in the context-sensitive action checklist that is presented to the operator, determining an alertness level of the operator of the vehicle system based on the input that is received from the operator in response to the one or more action items in the context-sensitive action checklist, and implementing one or more alerting actions to increase the alertness level of the operator.

In one embodiment, an electronic job aid system includes one or more processors configured to be disposed onboard a vehicle system formed from one or more vehicles. The one or more processors are configured to determine conditions in which the vehicle system is operating or will operate during movement of the vehicle system along one or more routes. The one or more processors also are configured to generate or select a context-sensitive action checklist based on one or more of the conditions in which the vehicle system is operating or will operate. The one or more processors are configured to present the context-sensitive action checklist to an operator of the vehicle system during the movement of the vehicle system, and to receive input from the operator of the vehicle system during the movement of the vehicle system and in response to one or more action items in the context-sensitive action checklist that is presented to the operator. The one or more processors are configured to determine an alertness level of the operator of the vehicle system based on the input that is received from the operator in response to the one or more action items in the context-sensitive action checklist, and to implement one or more alerting actions to increase the alertness level of the operator.

BRIEF DESCRIPTION OF THE DRAWINGS

The present inventive subject matter will be better understood from reading the following description of non-limiting embodiments, with reference to the attached drawings, wherein below.

DETAILED DESCRIPTION

The subject matter described herein relates to an electronic job aid system that assists an operator of a vehicle system with many tasks. These tasks may otherwise be performed by another person onboard the vehicle system in the absence of the job aid system. For example, the job aid system can assist an engineer of a rail vehicle system with providing reminders of upcoming events, requesting or requiring that the engineer double-check compliance with operating rules, requesting or requiring that the engineer provide feedback indicating that the engineer had checked on and/or is aware of a state of a wayside signal, provide paperwork and incoming mandatory directives from a dispatcher to the engineer, provide context-relevant checklists of action items for the engineer to perform (which also can increase the alertness and vigilance of the engineer), etc.

The job aid system can be embodied in a mobile electronic device, such as a tablet computer or mobile phone, which optionally can be placed into a dock onboard the vehicle system as an operating screen for the vehicle system (e.g., for the locomotive). The job aid system can interface (e.g., communicate) with a control unit of the vehicle system (that controls operation of the vehicle system), with sensors of the vehicle system, with a dispatch facility, with wayside signals, with radio signals received from personnel off-board the vehicle system, etc. The job aid system can manage paperwork and information relevant to a trip of the vehicle system through electronic transmission of paperwork and through providing visualizations of information on train makeup, operating rules, and the like. The job aid system can provide situational awareness and vigilance enhancement through alerts and reminders that check and increase the awareness and alertness of the operator of the vehicle system. The job aid system can detect and report behavior of the vehicle system by generating visualizations of system behavior.

The description herein focuses on use of the job aid system 100 with an operator (e.g., an engineer) onboard a rail vehicle system, such as a train formed from one or more locomotives moving alone or with one or more cars (e.g., rail cars) that are mechanically coupled with the locomotive (s). Alternatively, in another embodiment, the job aid system 100 can be used with another type of vehicle system, such as an automobile, an aircraft, a marine vessel, or the like.

Figure 1:
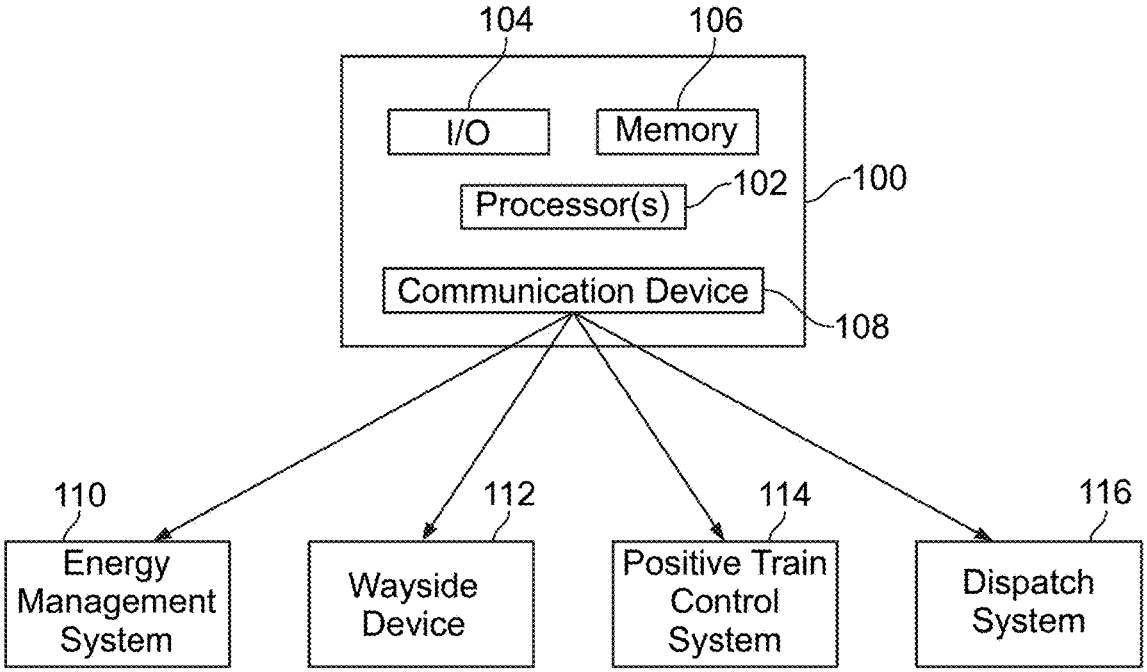
FIG. 1 illustrates one embodiment of an electronic job aid system.
Figure 2:
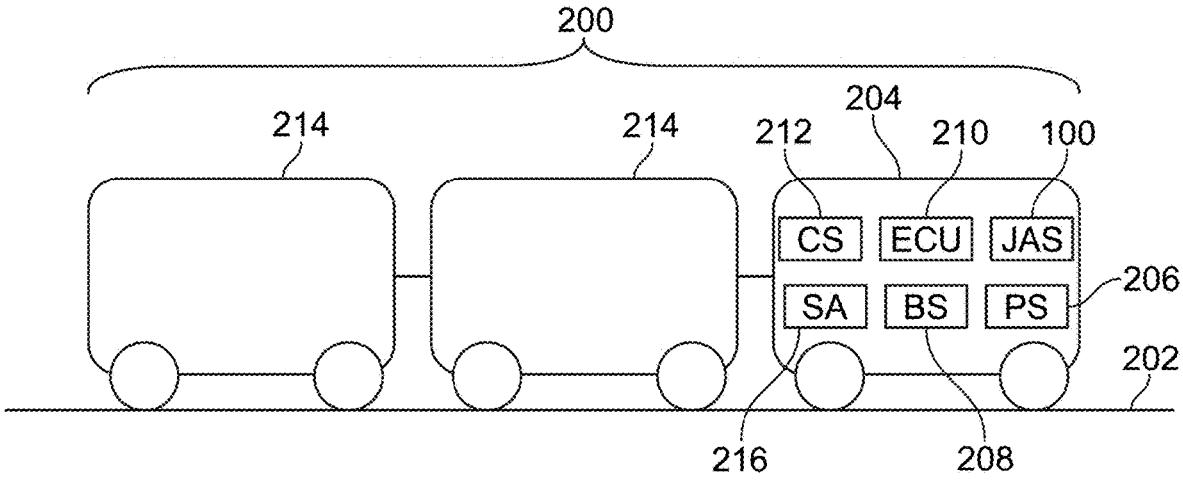
FIG. 2 illustrates the job aid system onboard a vehicle system.

FIG. 1 illustrates one embodiment of an electronic job aid system 100. FIG. 2 illustrates one embodiment of the job aid system 100 onboard a vehicle system 200. The job aid system 100 is labeled as JAS in FIG. 2. The job aid system 100 includes one or more processors 102 (e.g., one or more microprocessors, one or more field programmable gate arrays, and/or one or more integrated circuits) that perform the functions described herein in connection with the job aid system 100 (except as stated otherwise). The processors 102 interface with one or more input and/or output devices 104 ("I/O" in FIG. 1) to receive input from an operator located onboard the vehicle system 200 while the vehicle system 200 moves along one or more routes 202 (e.g., tracks, roads, waterways, airways, etc.). The input/output devices 104 can represent a touchscreen, electronic display, electronic mouse, keyboard, stylus, microphone, speaker, or the like.

The job aid system 100 can be disposed onboard a propulsion-generating vehicle 204 of the vehicle system 200, such as a locomotive or automobile. The propulsion-generating vehicle 204 includes a propulsion system 206 ("PS" in FIG. 2) formed of one or more engines, motors, generators, alternators, or the like, that operate to generate tractive effort or force that propels the vehicle system 200 along the route 202. The propulsion-generating vehicle 204 optionally includes a brake system 208 ("BS" in FIG. 2) formed of one or more brakes that operate to slow or stop movement of the vehicle system 200. The propulsion-generating vehicle 204 optionally can be coupled with one or more non-propulsion-generating vehicles 214 (e.g., rail cars) or other vehicles that cannot propel themselves.

The propulsion-generating vehicle 204 includes an engine control unit 210 ("ECU" in FIG. 2) that is formed from one or more processors that communicate signals to the propulsion system 206 and/or the brake system 208 to control movement of the vehicle system 200. The propulsion-generating vehicle 204 optionally includes a communication system 212 formed of hardware circuitry that can communicate with other vehicles 204 in the same vehicle system 200, with other vehicle systems 200, and/or other off-board locations (e.g., a dispatch facility, a wayside device, etc.). The communication system 212 ("CS" in FIG. 2) can include one or more antennas, routers, modems, receivers, transceivers, transmitters, etc. The job aid system 100 can communicate with off-board systems via the communication system 212, or can communicate with the off-board systems directly. The vehicle 204 optionally can include a sensor array 216 ("SA" in FIG. 2) that includes one or more sensors, such as one or more cameras, temperature sensors, force sensors, accelerometers, fuel gauges, tachometers, and the like. Data from the sensor array 216 can be communicated to the ECU 210 and/or job aid system 100.

The job aid system 100 includes a local memory 106, such as a computer hard drive, flash drive, optical disk, etc. The local memory 106 can store information described herein for presentation to the operator via the input/output device 104. A communication device 108 can include one or more antennas, routers, modems, receivers, transceivers, transmitters, etc., that allow the processors 102 to communicate with the engine control unit 210 and/or off-board systems.

The processors 102 of the job aid system 100 interface with one or more systems located on or off the vehicle system 200. An energy management system 110 represents a computing system that generates trip plans for movement of the vehicle system 200 in a trip. The trip plans dictate operational settings of the vehicle system 200 as a function of time, distance (along the routes 202), and/or location. These operational settings can be throttle settings, speeds, or the like. The energy management system 110 can be located onboard or off-board the vehicle system 200.

A wayside device 112 represents equipment located along or near the routes 202 that operate to inform the operator and/or restrict movement of the vehicle system 200. The wayside device 112 can include a signal that displays one or more lights to inform the operator that an upcoming section of the route 202 is occupied or vacant, a speed limit sign, a gate that prevents other vehicles from crossing the routes 202, a switch at an intersection between two or more routes 202, etc.

A positive train control (PTC) system 114 represents a computing system that communicates with the engine control unit 210 to automatically stop or slow movement of the vehicle system 200. For example, the PTC system 114 can communicate with the engine control unit 210 to slow down the vehicle system 200 to a slower speed limit, to cause the vehicle system 200 to engage the brake system 208 due to an upcoming hazard, etc.

A dispatch system 116 represents a computing system in a facility that communicates with the vehicle system 200 and other vehicle systems to schedule trips of the vehicle systems, dictate which routes 202 are to be traveled by different vehicle systems 200, dictate speed limits along the routes 202, dictate track warrants for the routes 202, and the like.

The processors 102 of the job aid system 100 communicate with one or more of these systems 110, 112, 114, 116 to obtain information that is used to inform the operator onboard the vehicle system 200, generate context-relevant checklists, and the like. The processors 102 communicate and display context-sensitive information from the systems 110, 112, 114, 116 to the operator, and can send updates or digital acknowledgements by the operator back to one or more of the systems 110, 112, 114, 116.

The information that is communicated from one or more of the systems 110, 112, 114, 116 to the operator via the job aid system 100 can cause the processors 102 to direct the input/output device 104 to present alerts and/or reminders of upcoming events, such as the vehicle system 200 approaching a grade crossing, a speed restriction, a section of the route 202 under maintenance, etc. The processors 102 can direct the input/output device 104 to display mandatory directives of track warrants received from the dispatch system 116. A track warrant can require that the operation obtain permission (from the dispatch system 116) before entering an upcoming section of a route 202 at a speed limit dictated by the track warrant). The processors 102 also can generate verification checklists of procedures to perform. These checklists can be procedures for troubleshooting activated or failed alarms, procedures for checking or ensuring compliance with operating rules of the route 202 and/or vehicle system 200.

The processors 102 can monitor how the operator is controlling the vehicle system 200, and calculate performance metrics that indicate how well (or poorly) the operator is performing in controlling the vehicle system 200. These metrics can indicate the quality of handling of the vehicle system 200, which can represent good performance when inter-car forces in the vehicle system 200 are smaller and can represent poor performance when the inter-car forces are larger.

Optionally, these metrics can reflect the upcoming or expected workload of the operator. For example, if the processors 102 determine that the operator has a long checklist with many action items to complete in the near future, the processors 102 can display a notification to the operator to help the operator to prepare for completing the many action items (e.g., by beginning work on the action items sooner and/or completing other items sooner).

Optionally, these metrics can reflect the alertness of the operator. For example, the processors 102 can form a checklist of action items for the operator to perform. These action items can request responses from the operator that require the operator to move through several different menus and/or screens displayed on the input/output device, or other locomotive operating screens or gauges, to determine the answer to a question. For example, an action item of a checklist can ask the operator to input how far the vehicle system 200 currently is located from a previous location, to input how much fuel the vehicle system 200 has consumed since a previous fuel measurement, to input a signal strength level between radios onboard different vehicles in the vehicle system 200, or the like. The processors 102 can determine the correct responses to the questions, and compare the operator's responses with the processor-determined responses. The closer that the operator's responses are to the correct responses, the greater that the metric representing operator alertness will be set by the processors 102. The farther that the operator's responses are from the correct responses, the smaller that the metric representing operator alertness will be set by the processors 102.

Figure 3:
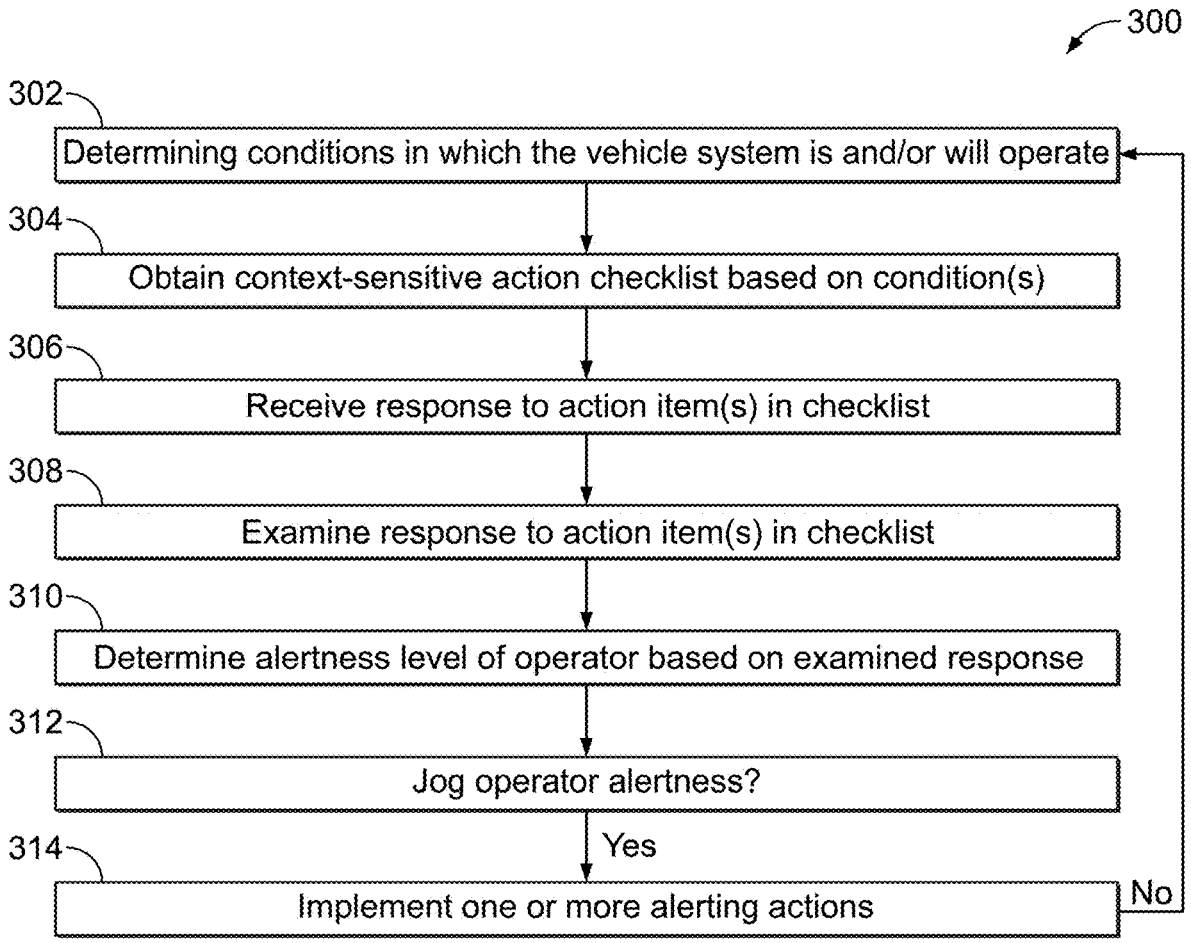
FIG. 3 illustrates a flowchart of one embodiment of a method for providing context-sensitive, alertness-triggering checklists to an operator of a vehicle system.
Figure 4:
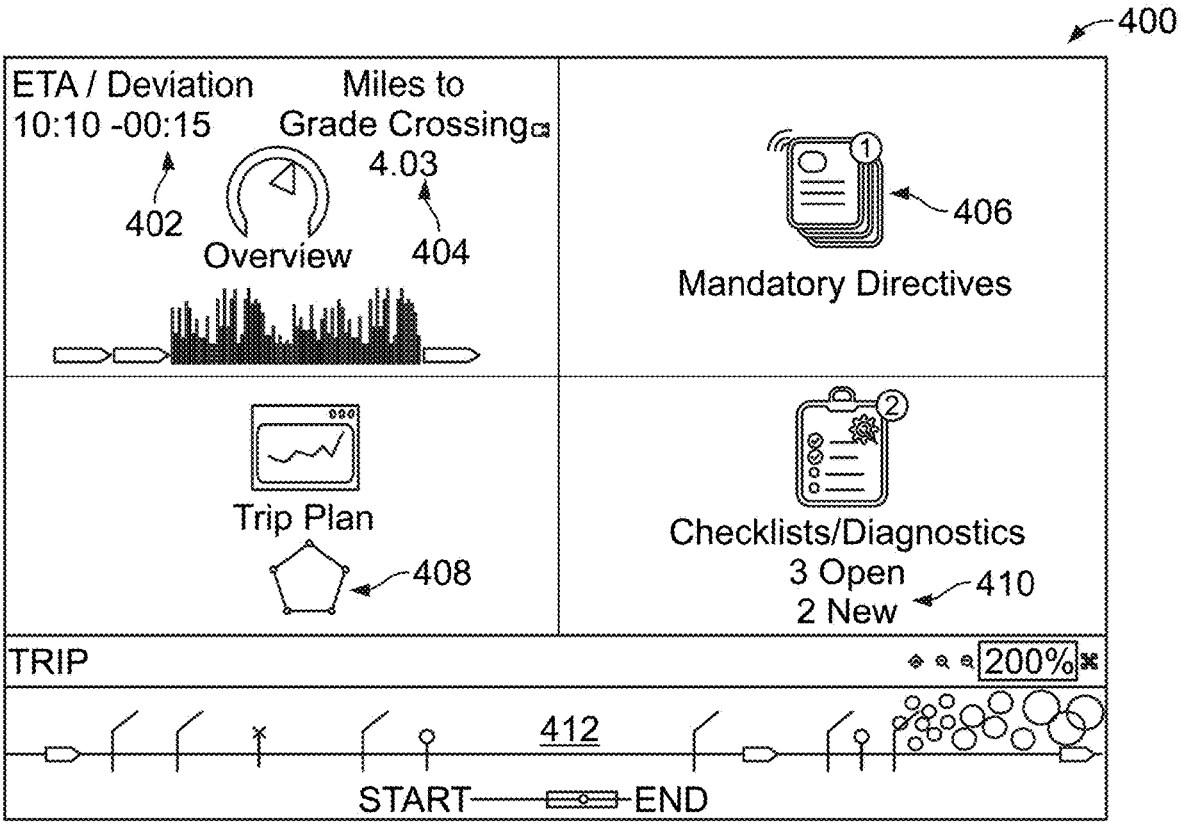
FIG. 4 illustrates an example of a user interface that can be presented to an operator of the vehicle system shown in FIG. 1 by the job aid system shown in FIG. 1.
Figure 5:
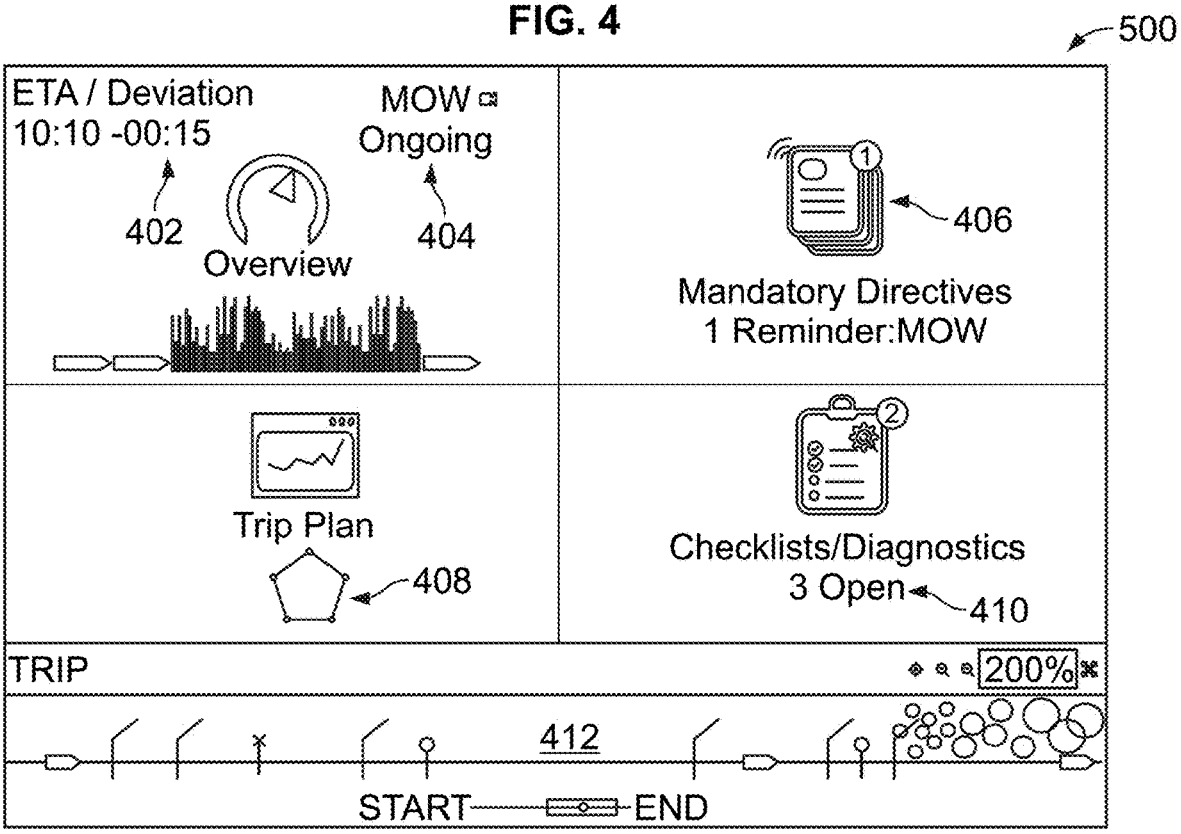
FIG. 5 illustrates another example of a user interface that can be presented to an operator of the vehicle system shown in FIG. 1 by the job aid system shown in FIG. 1.
Figure 6:
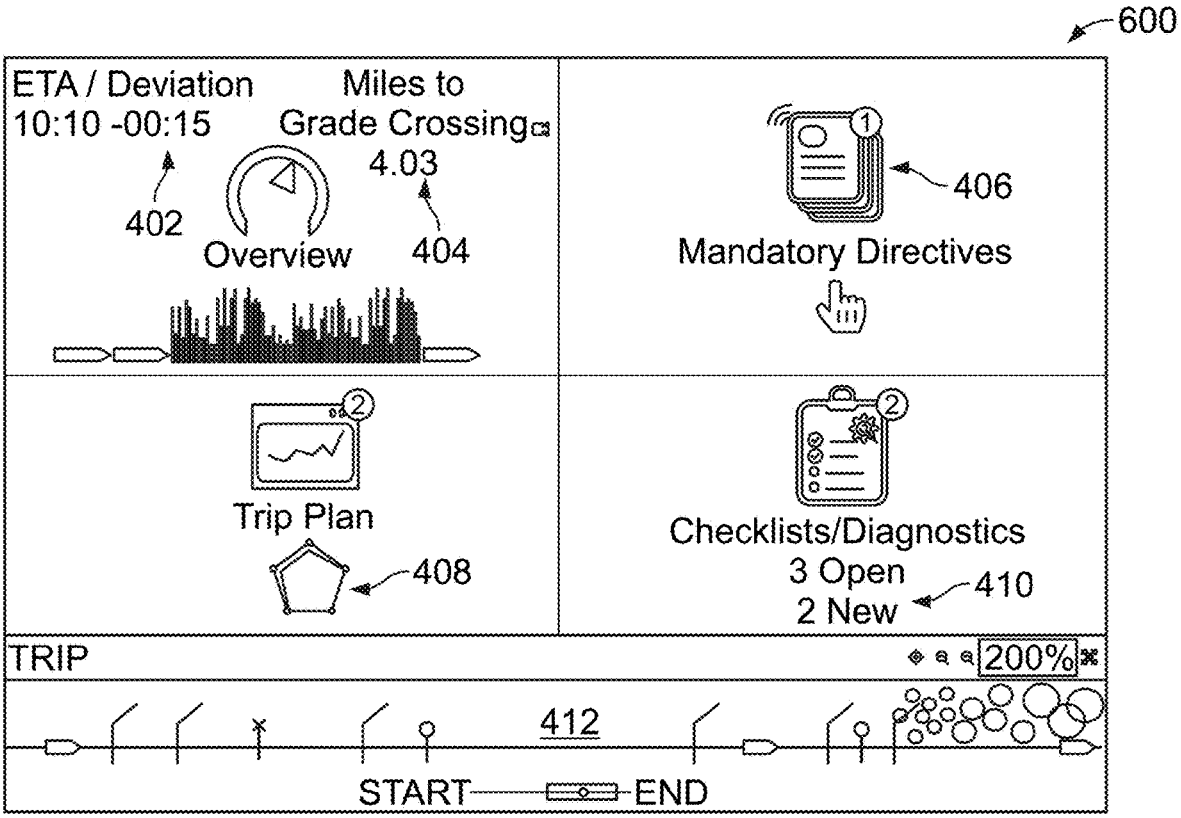
FIG. 6 illustrates another example of a user interface that can be presented to an operator of the vehicle system shown in FIG. 1 by the job aid system shown in FIG. 1.
Figure 7:
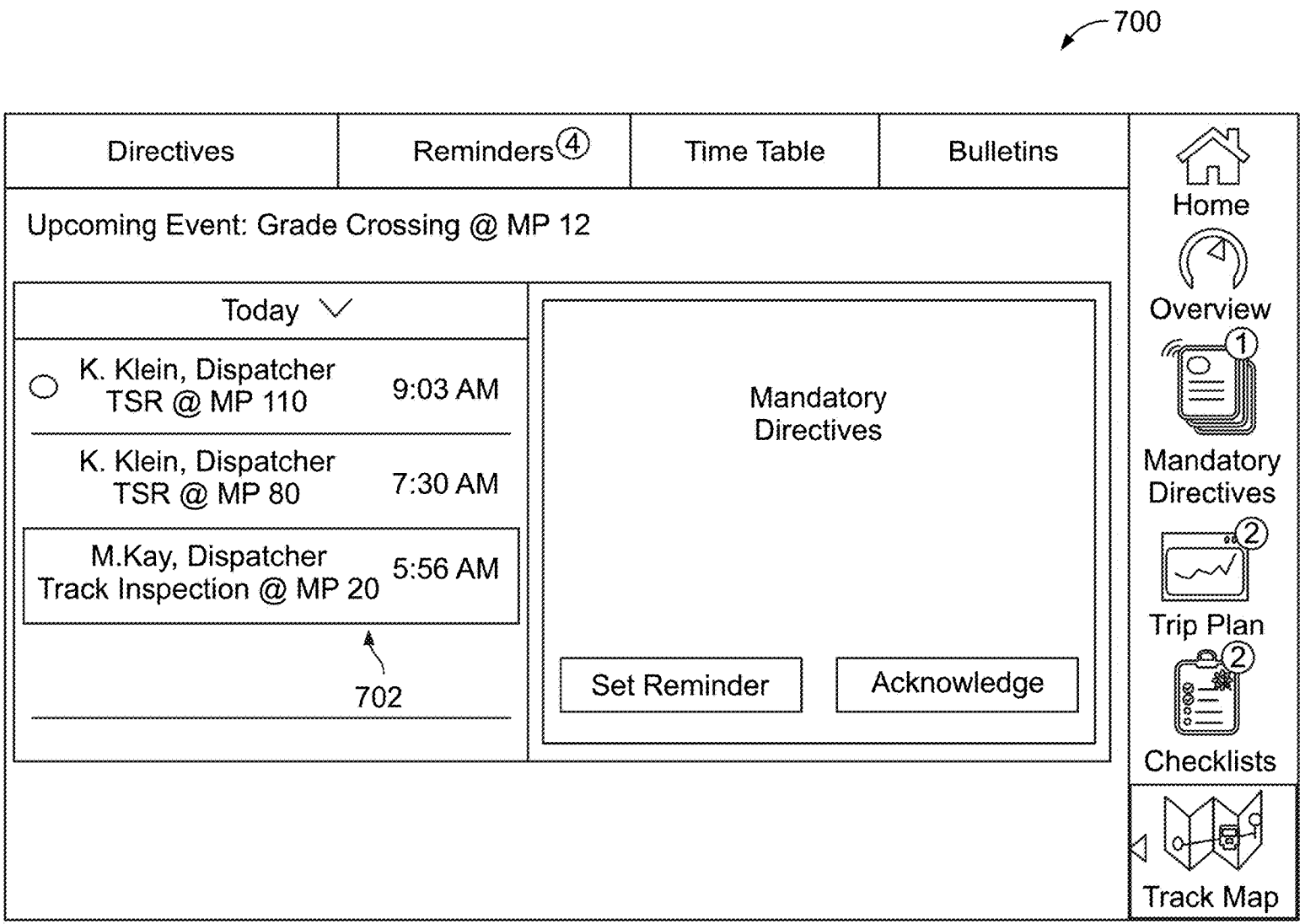
FIG. 7 illustrates another example of a user interface that can be presented to an operator of the vehicle system shown in FIG. 1 by the job aid system shown in FIG. 1.
Figure 8:
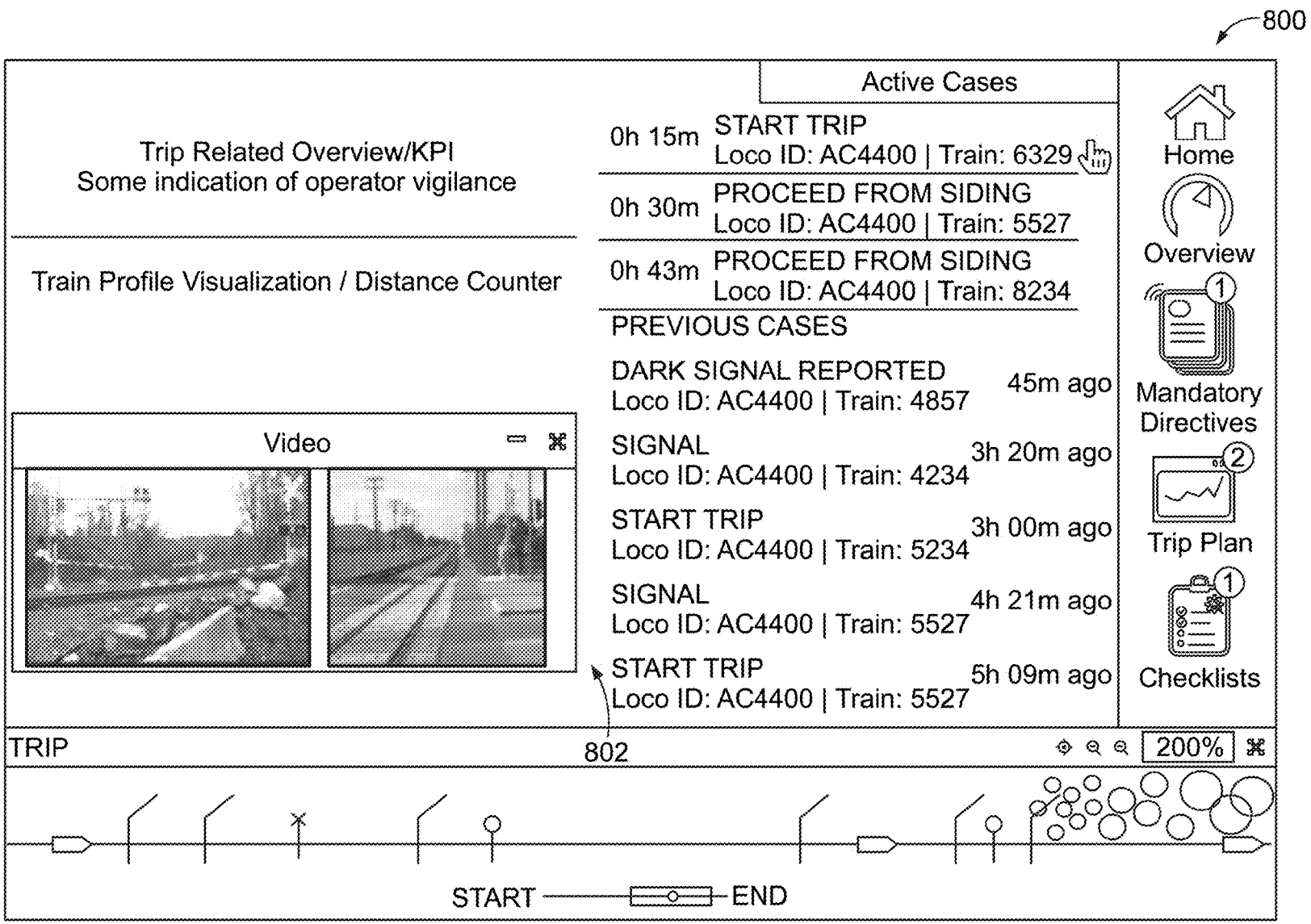
FIG. 8 illustrates another example of a user interface that can be presented to an operator of the vehicle system shown in FIG. 1 by the job aid system shown in FIG. 1.
Figure 9:
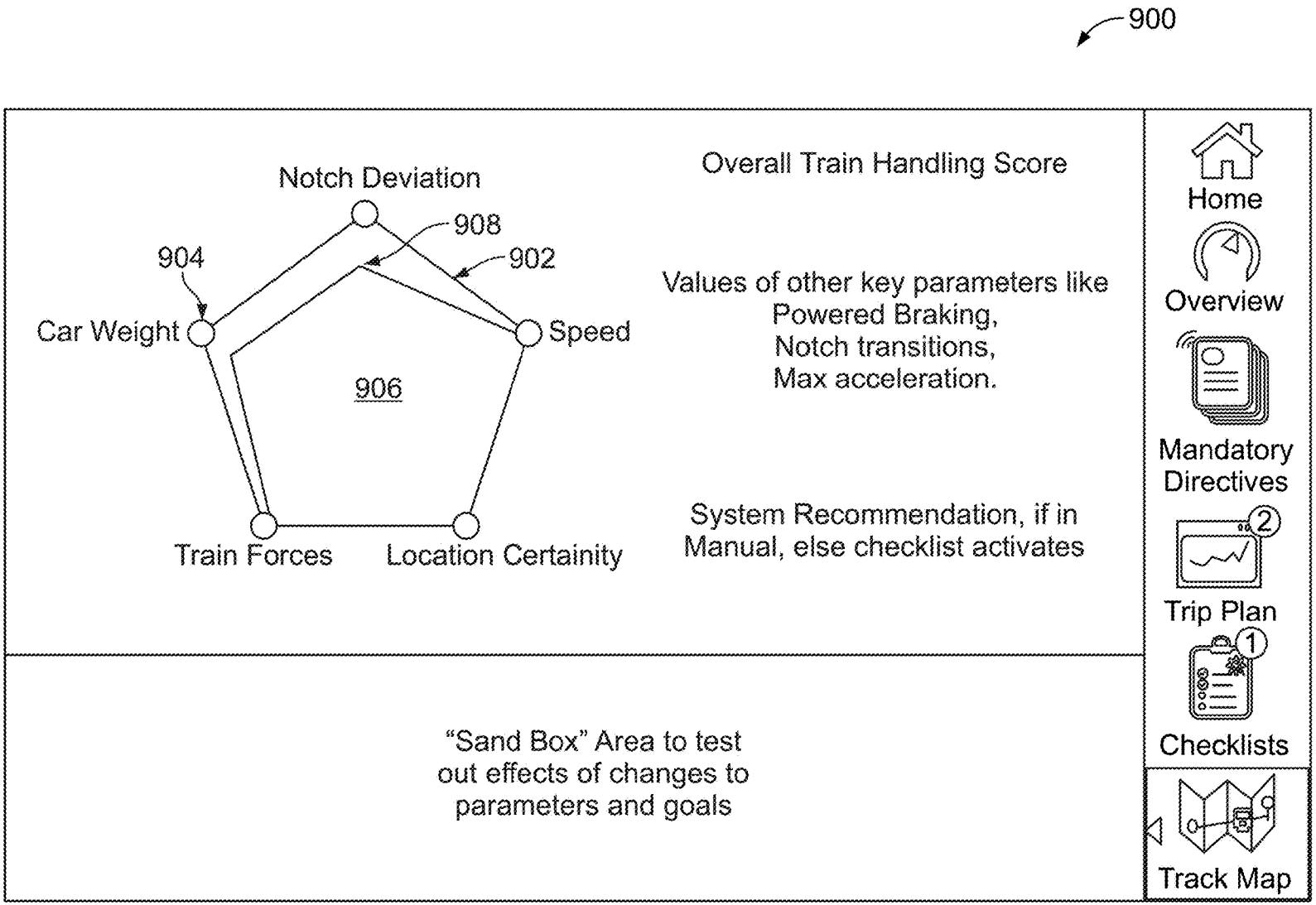
FIG. 9 illustrates another example of a user interface that can be presented to an operator of the vehicle system shown in FIG. 1 by the job aid system shown in FIG. 1.
Figure 10:
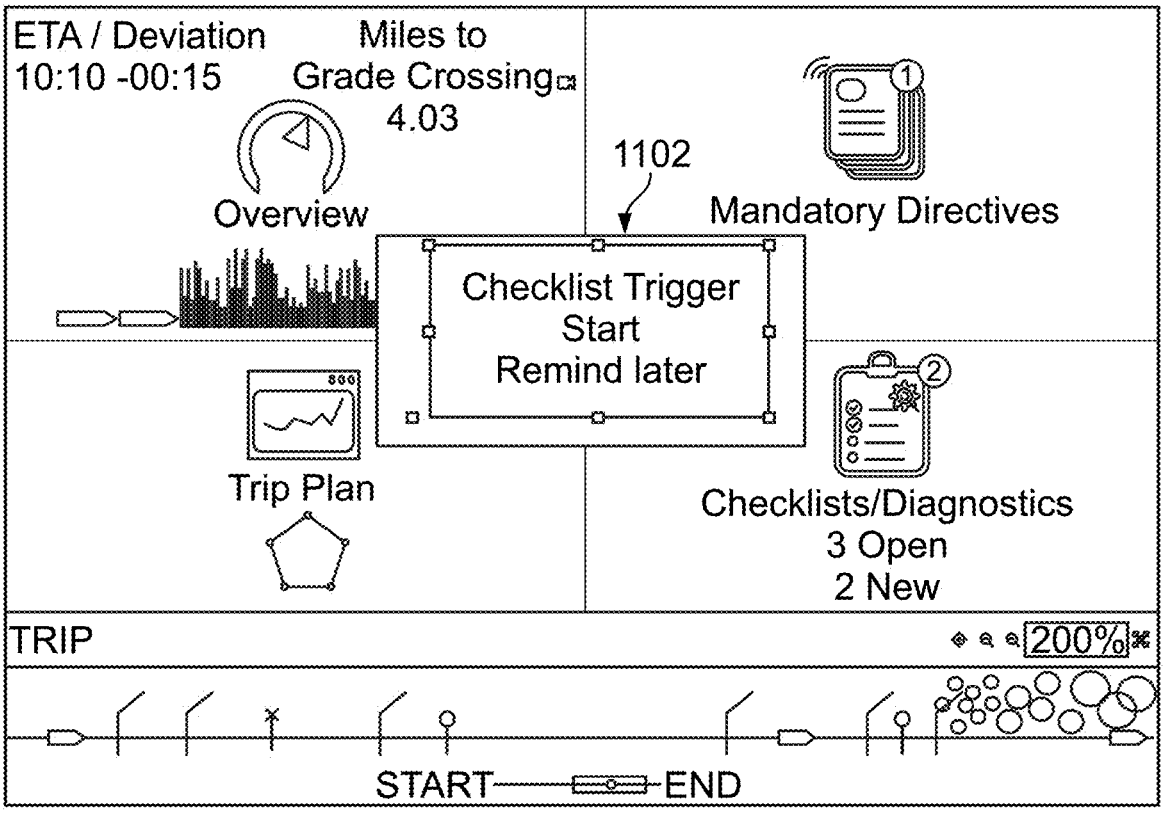
FIG. 10 illustrates another example of a user interface that can be presented to an operator of the vehicle system shown in FIG. 1 by the job aid system shown in FIG. 1.
Figure 11:
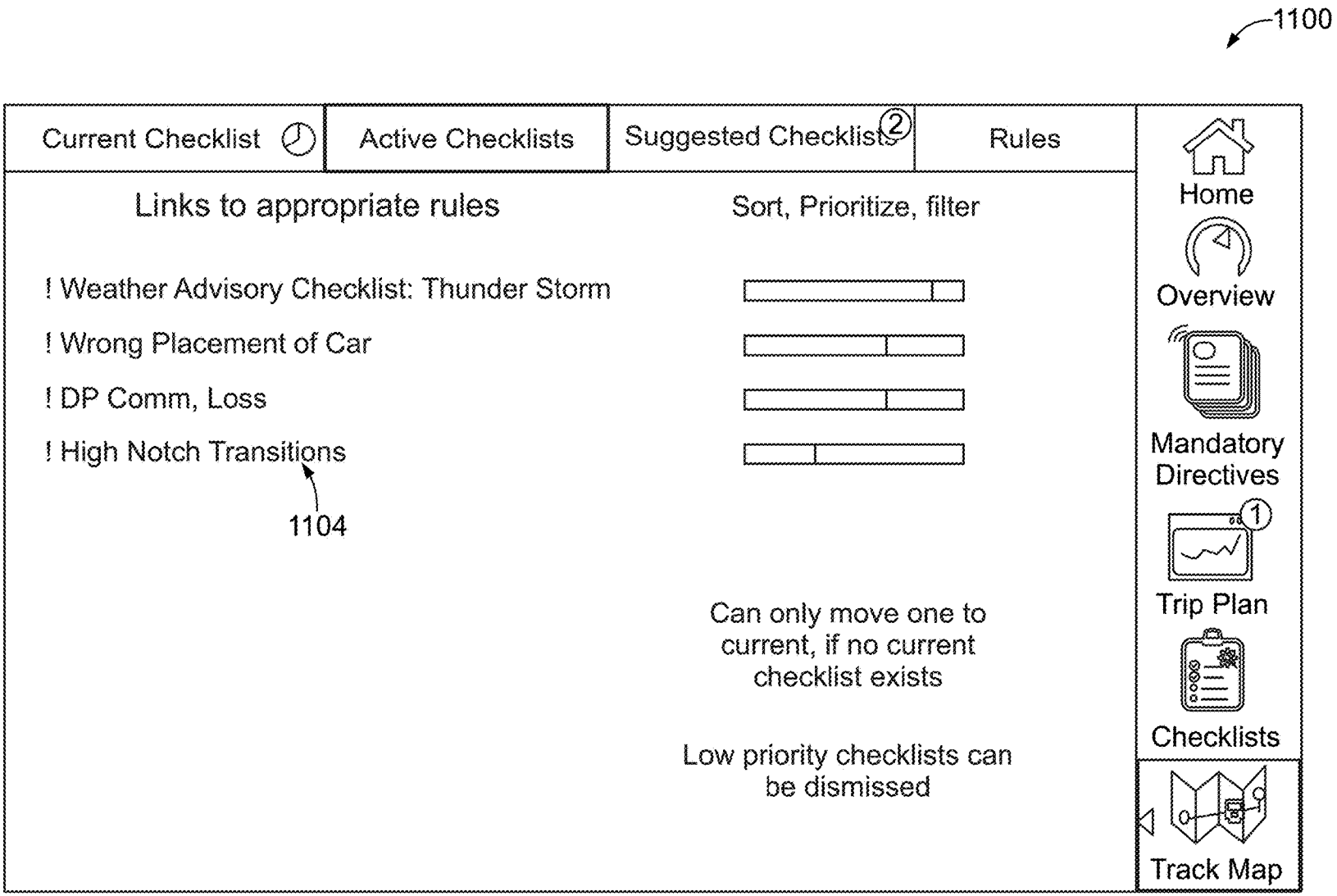
FIG. 11 illustrates another example of a user interface that can be presented to an operator of the vehicle system shown in FIG. 1 by the job aid system shown in FIG. 1.
Figure 12:
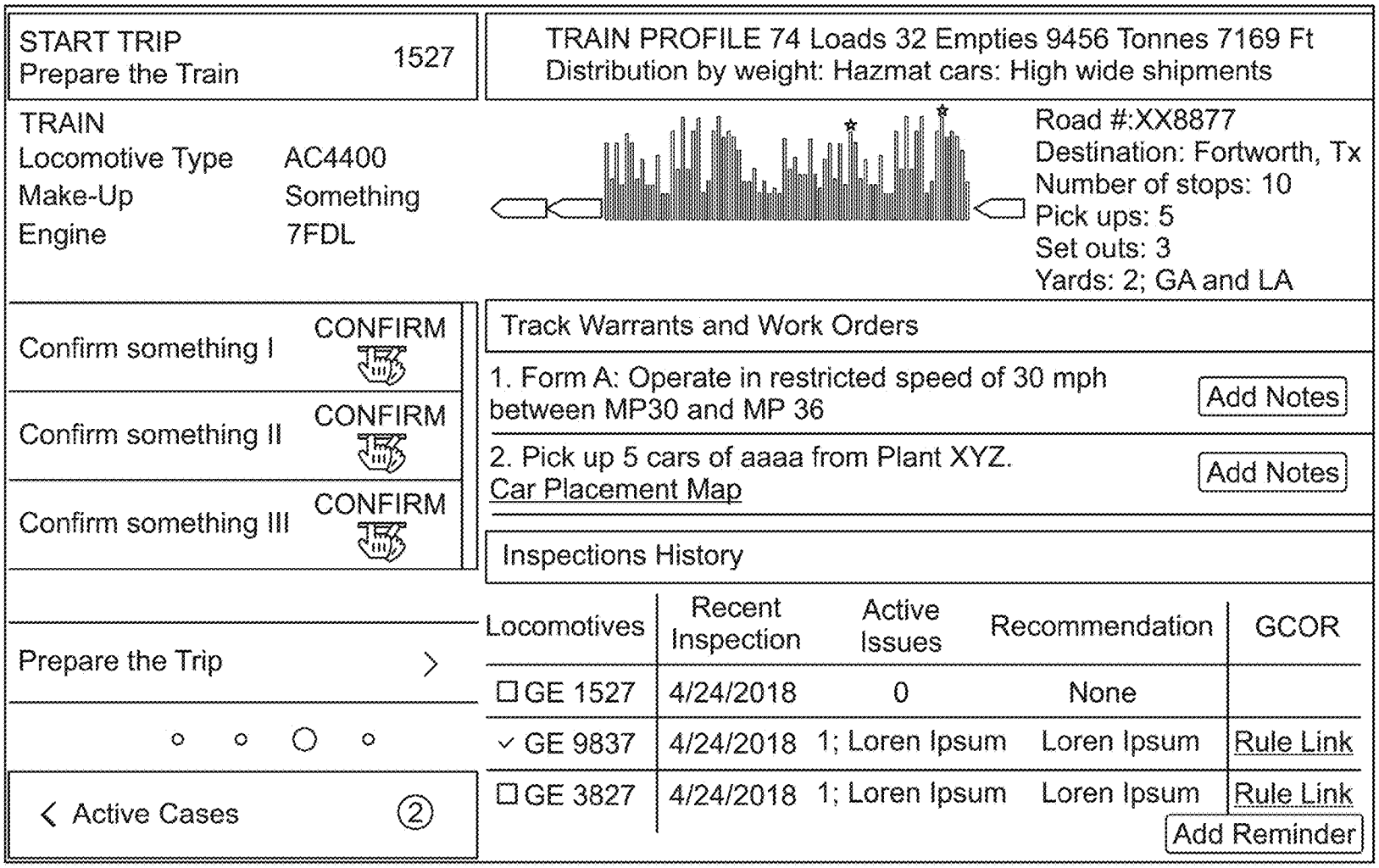
FIG. 12 illustrates another example of a user interface that can be presented to an operator of the vehicle system shown in FIG. 1 by the job aid system shown in FIG. 1.

FIG. 3 illustrates a flowchart of one embodiment of a method 300 for providing context-sensitive, alertness-triggering checklists to an operator of a vehicle system. The method 300 can be performed by operation of the processors 102 of the job aid system 100 to ensure that the operator of the vehicle system 200 is alert using checklists that request operator responses to inquiries related to a current operating state and/or condition of the vehicle system 200 (e.g., the context of operation of the vehicle system 200), where the operator is made more alert in controlling the vehicle system 200 by way of providing the responses.

At 302, conditions in which the vehicle system 200 is operating or will operate during movement of the vehicle system 200 along one or more routes 202 are determined. These conditions can be determined by sensors 216 onboard the vehicle system 200. The conditions can include a location of the vehicle system 200, which can be determined from a global positioning system receiver, by integrating the velocity of the vehicle system 200 from a known location over the time since the vehicle system 200 departed from or passed the known location, by wirelessly triangulating the location of the vehicle system 200, by receiving signals from wayside devices 112, etc.

Another condition that can be determined is a moving speed of the vehicle system 200, which can be determined based on data output by the sensor array 216 (e.g., a tachometer, global positioning system receiver, etc.). Another condition that can be determined is a current throttle setting and/or brake setting of the vehicle system 200. The current throttle setting and/or brake setting can be determined from information provided by the engine control unit 210. Another condition that can be determined is an upcoming location, upcoming throttle setting, upcoming speed, and/or upcoming brake setting of the vehicle system 200. This information can be determined from a trip plan of the vehicle system 200, which can dictate the vehicle system 200 location, throttle setting, brake setting, and/or speed as a function of time, distance along a route 202, and/or location.

At 304, a context-sensitive action checklist is generated or selected based on one or more of the operating conditions that are determined. The processors 102 can generate the checklist and display the checklist to the operator via the input/output device 104, or can select the checklist from among several different checklists stored in the memory 106, based on the operating condition(s) that is or are determined. The context-sensitive action checklist that is generated or selected includes the one or more action items that request responses from the operator that indicate performance of the vehicle system 200.

As one example, the checklist can include an action item that requests the operator indicate how far the movement of the vehicle system 200 has deviated from a trip plan. The trip plan can dictate the movement of the vehicle system 200 as a function of one or more of time, location, or distance along the one or more routes 202. The operator may be required to determine whether the vehicle system 200 has traveled farther than the trip plan has directed at that time or whether the vehicle system 200 has not traveled as far as the trip plan has directed at that time.

As another example, the operator may be required to determine whether vehicle system 200 has consumed more fuel or less fuel than should have been consumed (if the vehicle system 200 was moving according to the trip plan). Optionally, the operator may be required to determine whether a current throttle setting of the vehicle system 200 is different from a throttle setting that is designated by the trip plan at the current time, location, or distance along the route 202. In another example, the operator may be required to determine whether a current speed of the vehicle system 200 deviates from a designated speed of the trip plan at the current time, location, or distance along the route 202.

Optionally, the operator may be required to determine whether inter-car forces between neighboring cars 214 of the vehicle system 200 exceed one or more thresholds. The operator can be required to determine whether a weight of one or more cars 214 of the vehicle system 200 exceeds a designated threshold (e.g., associated with safe travel or a rule of the owner of the vehicle system 200).

In one embodiment, the checklist may require that the operator calculate or estimate one or more of the measurements described above, and/or how far the measurement deviates from an expected measurement, a correct measurement, or the like. For example, an action item in the checklist can require that the operator respond with a distance (e.g., in terms of kilometers, miles, or the like) that represents how far the movement of the vehicle system 200 has deviated from a trip plan (as calculated by the operator). As another example, the operator may be required to calculate or estimate how much more or less fuel that the vehicle system 200 has consumed relative to the amount of fuel that the vehicle system 200 should have consumed so far according to the trip plan.

Optionally, the operator may be required to determine how far the current throttle setting of the vehicle system 200 differs from the designated throttle setting of the trip plan. In another example, the operator may be required to calculate or estimate how much a current speed of the vehicle system 200 deviates from the designated speed of the trip plan. The operator may be required to calculate or estimate the inter-car forces and/or how much the inter-car forces exceed the one or more thresholds. The operator can be required to calculate or estimate how much heavier or lighter one or more cars 214 of the vehicle system 200 is than the designated threshold.

The context-sensitive action checklist that is generated or selected can include action items that request responses from the operator that indicate an upcoming trip event that the vehicle system 200 is heading toward along the one or more routes 202. The upcoming trip event can include a change in speed limit of a route 202, and the checklist can ask the operator what the speed limit is for the route 202. As another example, the upcoming trip event can include an approach of the vehicle system 200 to a section of a route 202 that is under maintenance. The checklist can ask the operator whether the vehicle system 200 is approaching any such sections of the route 202.

The checklist can ask the operator whether the vehicle system 200 is approaching a crossing gate of a wayside device 112, or an area restricted by one or more track warrants. The checklist optionally may ask the operator whether the vehicle system 200 is approaching a section of a route 202 having a reduced speed restriction. The speed limit or restriction for a route 202 may be due to maintenance on the route 202, due to the route 202 being occupied by another vehicle system 200, due to debris or other foreign objects on the route 202, etc. The reduced speed restriction may have been previously communicated to the control unit 210 by a radio that is off-board the vehicle system 200, from a wayside device 112, from the dispatch system 116, or the like.

The checklist also can include a request that the operator provide input confirming or refuting whether the vehicle system 200 includes a car 214 having special handling instructions or requirements. A car 214 may have special handling instructions or requirements when the car 214 is carrying hazardous cargo, when the car 214 is carrying fragile cargo, when the car 214 is carrying cargo that will spoil if not delivered within a certain period of time, when the car 214 is over a weight limit, or the like. The special handling instructions can include limitations on how fast (or slow) the car 214 is permitted to move, whether the car 214 must be located a certain distance away from another car 214 or propulsion-generating vehicle 204 in the vehicle system 200, whether the car 214 is not permitted to travel through one or more geographic areas, or the like. The processors 102 can determine whether any special handling instructions apply from the dispatch system 116 in one embodiment.

The checklist also can include a request that the operator provide input confirming or refuting whether a signal received from a wayside device 112 was received (e.g., seen by the operator) and that a travel restriction represented by the signal was complied with by the vehicle system 200. The wayside device 112 may illuminate a light, change a displayed sign, or the like, to instruct the vehicle system 200 to slow down, to stop, to avoid entering a section of a route 202, or the like. The processors 102 can determine whether the signal is received and complied with using data from the sensors 216 (to identify the signal) and from the engine control unit 210 (to determine whether the restriction was complied with).

The context-sensitive checklist can be generated or selected based on a single operating condition or state, or a combination of operating conditions or states. As one example, the context-sensitive checklist is generated or selected by the processors 102 based on a geographic location of the vehicle system 200. The checklist may change for different geographic locations as the track warrants, speed restrictions, trip plan requirements, etc., may be different for different geographic locations of the vehicle system 200. As another example, the context-sensitive checklist is generated or selected by the processors 102 based on a temporal duration since the operator last provided a response to a previous checklist. The processors 102 can change the action items included in a checklist based on how long it has been since the operator last completed an action item on a checklist. For example, for longer durations since the last action item was completed, the processors 102 may generate a checklist having more action items and/or having action items that require more calculations or work for the operator to determine the responses to the action items. Conversely, for shorter durations since the last action item was completed, the processors 102 may generate a checklist having fewer action items and/or having action items that require fewer calculations or work for the operator to determine the responses to the action items.

At 306, a response to one or more action items in the context-sensitive checklist is received. The processors 102 can receive the input provided by the operator via the input/output device 104 as the response to the action item(s) in the checklist. The checklist includes context-sensitive action items so that the requests for information in the checklist are both relevant to the current operating state or condition of the vehicle system 200 and are not repeated. Requests that are not tailored to the current operating state or condition can become repetitive and easier for the operator to recall without much effort and/or without the operator being alert. Additionally, requests that are relevant to the current operating state or condition of the vehicle system 200 can prompt the operator to be more aware of the operation of the vehicle system 200. In contrast to other alert-jogging systems that may merely require an operator to actuate a button, lever, etc., requiring the operator to respond to the context-sensitive checklists (as described herein) can be more effective in keeping the mind of the operator alert and aware of current operations of the vehicle system 200, especially on long, monotonous stretches of a trip of the vehicle system 200.

At 308, the response to the action item(s) is examined. The processors 102 can examine how quickly the operator provided the response to the action item (following presentation of the action item), and/or how accurate the response provided by the operator is. For example, the processors 102 can calculate the correct or expected measurements for one or more of the above examples based on the trip plan received from the energy management system 110, from data of the sensors 216, from information received from the wayside device 112, from a trip manifest (e.g., received from the dispatch system 116), and/or from the positive train control system 114.

The processors 102 can examine the operator-provided response(s) and compare the response(s) to the correct or expected measurements. Based on this comparison, the processors 102 can determine how accurate or inaccurate the operator-provided responses are. For example, the processors 102 can determine if the difference between the operator-provided response and the correct measurement is small (e.g., less than one or more thresholds) or large (e.g., more than the one or more thresholds). The processors 102 optionally can examine the operator-provided response to determine how quickly the response was input by the operator into the input/output device 104.

At 310, an alertness level of the operator is determined based on the operator-provided response or responses provided by the operator to the action item or items in the context-sensitive checklist. In one embodiment, the processors 102 can determine how accurate and/or timely that a response was provided by the operator, and determine how alert the operator is based on the accuracy and/or timeliness.

For example, if the processors 102 determine that an operator-provided response was within a first designated range (e.g., 3%) of the correct measurement and/or that the response was provided within a first designated time period (e.g., one minute), then the processors 102 can assign a large value to the alertness level of the operator. If the processors 102 determine that an operator-provided response was within a larger, second designated range (e.g., 5%) of the correct measurement and/or that the response was provided within a longer, second designated time period (e.g., two minutes), then the processors 102 can assign a smaller value to the alertness level of the operator. If the processors 102 determine that an operator-provided response was within a larger, third designated range (e.g., 15%) of the correct measurement and/or that the response was provided within a longer, third designated time period (e.g., five minutes), then the processors 102 can assign an even smaller value to the alertness level of the operator, and so on.

At 312, a determination is made as to whether the alertness of the operator is to be jogged. For example, a determination can be made by the processors 102 as to whether the alertness level of the operator is below a designated level, and whether one or more actions need to be taken to increase the operator's alertness level. If the alertness level is too low (e.g., below the designated level), then flow of the method 300 can proceed toward 314. Otherwise, flow of the method 300 can return toward 302 or terminate.

At 314, one or more actions are implemented to increase the alertness level of the operator. The processors 102 can direct the input/output device 104 to generate bright lights and/or to generate loud noises. Optionally, the processors 102 can require the operator to play an interactive game or other process using the input/output device 104. Alternatively, one or more other actions may be implemented. Flow of the method 300 can then return toward 302 or can then terminate.

FIGS. 4 through 12 illustrate examples of different user interfaces 400, 500, 600, 700, 800, 900, 1000, 1100, 1300 that can be presented to the operator of the vehicle system 200 by the processors 102 of the job aid system 100 via the input/output device 104. The interfaces 400, 500, 600 illustrate overviews of the current operating states or conditions of the vehicle system 200. For example, the interfaces 400, 500, 600 show a deviation 402 from a scheduled time of arrival at a location, a distance 404 to an upcoming wayside device 112 (e.g., a crossing), a directive or track warrant indicator 406 that notifies the operator of an applicable and/or upcoming track warrant, a trip plan summary 408 that represents how close or far the current state of the vehicle system 200 is from the planned state (e.g., as dictated by the trip plan), and a checklist summary 410 that indicates how many checklists have remaining action items to complete. The interfaces 400, 500, 600 optionally can show a trip map 412, which indicates the progress of the vehicle system 200 toward one or more locations along the routes 202.

The interface 700 provides details on a track warrant or other directive 702. The warrant or directive can be received from the dispatch system 116 and/or from a maintenance crew, and can direct the vehicle system 200 to slow down, take another route 202 to a location, or the like. The interface 700 can require the operator acknowledge receipt and understanding of the warrant or directive, such as by actuating one or more icons or buttons on the interface 700.

The interface 800 can include details of the trip plan for the trip of the vehicle system 200, as well as data from the sensor array 216. For example, sensor data 802 can include video or images from a camera. The interface 900 can indicate how closely or far the vehicle system 200 is operating from the operational settings dictated by the trip plan. In the illustrated example, a geometric shape 902 (e.g., a pentagon) shows five goal points 904 that each represent an operational setting dictated by a trip plan for a current location of the vehicle system 200. An internal shape 906 inside the geometric shape 902 includes exterior points 908 that are closer to or farther from the goal points 904 for the corresponding operational settings. For example, as the exterior point 908 is farther from the corresponding goal point 904, the farther the corresponding operational setting is from that operational setting of the trip plan. In the illustrated example, the current speed of the vehicle system 200 is very close or identical to the speed designated by the trip plan, while the throttle setting (e.g., "notch") used by the vehicle system 200 deviates from the throttle setting dictated by the trip plan.

The interface 1000 can be shown to the operator in response to a new context-sensitive checklist being created or obtained by the processors 102. An indicator 1002 can be shown to the operator, and the operator may select the indicator 1002 to be shown the checklist at a current or later time.

The interface 1100 provides one example of a checklist. As shown, the checklist can include several prompts 1102 for information from the operator. The operator can use the input/output device 104 to provide the responses to the prompts 1102, as described above. The interface 1200 provides a summary of information about the vehicle system 200. For example, the interface 1200 can inform the operator of the contents of the vehicle system 200 (e.g., the train profile), upcoming track warrants and work orders, and a history of inspections, among other information.

In one embodiment, a method includes determining conditions in which a vehicle system is operating or will operate during movement of the vehicle system along one or more routes, generating or selecting a context-sensitive action checklist based on one or more of the conditions in which the vehicle system is operating or will operate, presenting the context-sensitive action checklist to an operator of the vehicle system during the movement of the vehicle system, receiving input from the operator of the vehicle system during the movement of the vehicle system and in response to one or more action items in the context-sensitive action checklist that is presented to the operator, determining an alertness level of the operator of the vehicle system based on the input that is received from the operator in response to the one or more action items in the context-sensitive action checklist, and implementing one or more alerting actions to increase the alertness level of the operator.

Optionally, at least one of the action items in the context-sensitive action checklist requests information obtained from another operating screen or gauge onboard the vehicle system.

Optionally, the context-sensitive action checklist that is generated or selected includes the one or more action items that request responses from the operator that indicate performance of the vehicle system.

Optionally, the one or more action items request the responses from the operator that indicate how far actual movement of the vehicle system deviates from a trip plan that dictates the movement of the vehicle system as a function of one or more of time, location, or distance along the one or more routes.

Optionally, the one or more action items request the responses from the operator that indicate how far a current throttle setting of the vehicle system deviates from a designated throttle setting that is designated by a trip plan as a function of one or more of time, location, or distance along the one or more routes.

Optionally, the one or more action items request the responses from the operator that indicate how far a current speed of the vehicle system deviates from a designated speed that is designated by a trip plan as a function of one or more of time, location, or distance along the one or more routes.

Optionally, the one or more action items request the responses from the operator that indicate inter-car forces between neighboring cars of the vehicle system.

Optionally, the one or more action items request the responses from the operator that indicate a weight of one or more cars of the vehicle system.

Optionally, the context-sensitive action checklist that is generated or selected includes the one or more action items that request responses from the operator that indicate one or more upcoming trip events that the vehicle system is heading toward along the one or more routes.

Optionally, the one or more upcoming trip events include a change in speed limit of the one or more routes.

Optionally, the one or more upcoming trip events include an approach to a section of the one or more routes under maintenance.

Optionally, the one or more upcoming trip events include an approach to a crossing gate along the one or more routes.

Optionally, the one or more upcoming trip events include an approach to an area restricted by one or more track warrants.

Optionally, the context-sensitive action checklist that is generated or selected requests that the operator confirm that the vehicle system is approaching a section of the one or more routes having a reduced speed restriction that previously was communicated to the operator via radio.

Optionally, the context-sensitive action checklist that is generated or selected requests that the operator confirm that the vehicle system includes a car carrying cargo requiring special handing.

Optionally, the context-sensitive action checklist that is generated or selected requests that the operator confirm that a signal received from a wayside device was received and that a travel restriction represented by the signal was complied with by the vehicle system.

Optionally, the context-sensitive action checklist that is generated or selected requests that the operator confirm content of a track warrant received by the operator.

Optionally, the context-sensitive action checklist is generated or selected based on a geographic location of the vehicle system.

Optionally, the context-sensitive action checklist varies based on a geographic location of the vehicle system.

Optionally, the context-sensitive action checklist is generated or selected based on a temporal duration since the operator last provided a response to a previous context-sensitive action checklist.

Optionally, the context-sensitive action checklist varies based on a length of time since the operator last completed another context-sensitive action checklist.

Optionally, the conditions in which the vehicle system is operating include one or more of a location of the vehicle system, a moving speed of the vehicle system, a throttle setting of the vehicle system, or a brake setting of the vehicle system.

Optionally, the alertness level of the operator that is determined indicates how alert the operator is while controlling movement of the vehicle system.

Optionally, the alertness level of the operator is determined by comparing one or more responses to the context-sensitive action checklist that are received via the input from the operator with one or more designated responses.

Optionally, the one or more designated responses are determined by one or more sensors.

In one embodiment, an electronic job aid system includes one or more processors configured to be disposed onboard a vehicle system formed from one or more vehicles. The one or more processors are configured to determine conditions in which the vehicle system is operating or will operate during movement of the vehicle system along one or more routes. The one or more processors also are configured to generate or select a context-sensitive action checklist based on one or more of the conditions in which the vehicle system is operating or will operate. The one or more processors are configured to present the context-sensitive action checklist to an operator of the vehicle system during the movement of the vehicle system, and to receive input from the operator of the vehicle system during the movement of the vehicle system and in response to one or more action items in the context-sensitive action checklist that is presented to the operator. The one or more processors are configured to determine an alertness level of the operator of the vehicle system based on the input that is received from the operator in response to the one or more action items in the context-sensitive action checklist, and to implement one or more alerting actions to increase the alertness level of the operator.

Optionally, at least one of the action items in the context-sensitive action checklist requests information obtained from another operating screen or gauge onboard the vehicle system.

Optionally, the context-sensitive action checklist that is generated or selected includes the one or more action items that request responses from the operator that indicate performance of the vehicle system.

Optionally, the one or more action items request the responses from the operator that indicate how far actual movement of the vehicle system deviates from a trip plan that dictates the movement of the vehicle system as a function of one or more of time, location, or distance along the one or more routes.

Optionally, the one or more action items request the responses from the operator that indicate how far a current throttle setting of the vehicle system deviates from a designated throttle setting that is designated by a trip plan as a function of one or more of time, location, or distance along the one or more routes.

Optionally, the one or more action items request the responses from the operator that indicate how far a current speed of the vehicle system deviates from a designated speed that is designated by a trip plan as a function of one or more of time, location, or distance along the one or more routes.

Optionally, the one or more action items request the responses from the operator that indicate inter-car forces between neighboring cars of the vehicle system.

Optionally, the one or more action items request the responses from the operator that indicate a weight of one or more cars of the vehicle system.

Optionally, the context-sensitive action checklist that is generated or selected includes the one or more action items that request responses from the operator that indicate one or more upcoming trip events that the vehicle system is heading toward along the one or more routes.

Optionally, the one or more upcoming trip events include a change in speed limit of the one or more routes.

Optionally, the one or more upcoming trip events include an approach to a section of the one or more routes under maintenance.

Optionally, the one or more upcoming trip events include an approach to a crossing gate along the one or more routes.

Optionally, the one or more upcoming trip events include an approach to an area restricted by one or more track warrants.

Optionally, the context-sensitive action checklist that is generated or selected requests that the operator confirm that the vehicle system is approaching a section of the one or more routes having a reduced speed restriction that previously was communicated to the operator via radio.

Optionally, the context-sensitive action checklist that is generated or selected requests that the operator confirm that the vehicle system includes a car carrying cargo requiring special handing.

Optionally, the context-sensitive action checklist that is generated or selected requests that the operator confirm that a signal received from a wayside device was received and that a travel restriction represented by the signal was complied with by the vehicle system.

Optionally, the context-sensitive action checklist that is generated or selected requests that the operator confirm content of a track warrant received by the operator.

Optionally, the context-sensitive action checklist is generated or selected based on a geographic location of the vehicle system.

Optionally, the context-sensitive action checklist varies based on a geographic location of the vehicle system.

Optionally, the context-sensitive action checklist is generated or selected based on a temporal duration since the operator last provided a response to a previous context-sensitive action checklist.

Optionally, the context-sensitive action checklist varies based on a length of time since the operator last completed another context-sensitive action checklist.

Optionally, the conditions in which the vehicle system is operating include one or more of a location of the vehicle system, a moving speed of the vehicle system, a throttle setting of the vehicle system, or a brake setting of the vehicle system.

Optionally, the alertness level of the operator that is determined indicates how alert the operator is while controlling movement of the vehicle system.

Optionally, the alertness level of the operator is determined by comparing one or more responses to the context-sensitive action checklist that are received via the input from the operator with one or more designated responses.

Optionally, the one or more designated responses are determined by one or more sensors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter, including the best mode, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A method, comprising:

determining conditions in which a vehicle system is operating or will operate during movement of the vehicle system along one or more routes;

generating or selecting a context-sensitive action checklist based on one or more of the conditions in which the vehicle system is operating or will operate, the context-sensitive action checklist generated or selected to include a request for an operator of the vehicle system to perform a calculation and provide a result of the calculation for of one or more of (a) a deviation between the movement of the vehicle system and a trip plan that dictates planned operation of the vehicle system as a function of one or more of time, distance, or location along the one or more routes, (b) a difference between a planned amount of fuel to be consumed by the vehicle system and an actual amount of the fuel consumed by the vehicle system, (c) a difference between an actual throttle setting of the vehicle system and a planned throttle setting of the trip plan, (d) an inter-car force of the vehicle system, or (e) an amount of weight that a car of the vehicle system is overweight or underweight relative to a weight threshold;

presenting the context-sensitive action checklist to the operator of the vehicle system during the movement of the vehicle system;

receiving input from the operator of the vehicle system during the movement of the vehicle system and in response to one or more action items in the context-sensitive action checklist that is presented to the operator, the input from the operator including the result of the calculation from the request in the context-sensitive action checklist;

determining an alertness level of the operator of the vehicle system based on the result of the calculation that is received from the operator in response to the request for the calculation in the context-sensitive action checklist; and implementing one or more alerting actions to increase the alertness level of the operator.

2. The method of claim 1, wherein the context-sensitive action checklist is presented on a first operating screen or a first gauge onboard the vehicle system, and the request for the calculation in the action items in the context-sensitive action checklist requires information obtained from another, second operating screen or another, second gauge onboard the vehicle system.

3. The method of claim 1, wherein the context-sensitive action checklist that is generated or selected additionally includes the one or more action items that request a response from the operator that indicates one or more of performance of the vehicle system or an upcoming trip event that the vehicle system is heading toward along the one or more routes.

4. The method of claim 3, wherein the one or more action items request the response from the operator that indicates the upcoming trip event that the vehicle system is heading toward along the one or more routes, the upcoming trip event including one or more of a change in speed limit of the one or more routes, an approach to a section of the one or more routes under maintenance, an approach to a crossing gate along the one or more routes, or an approach to an area restricted by one or more track warrants.

5. The method of claim 1, wherein the context-sensitive action checklist that is generated or selected additionally requests that the operator confirms one or more of: that the vehicle system is approaching a section of the one or more routes having a reduced speed restriction that previously was communicated to the operator via radio, that the vehicle system includes a car carrying cargo requiring special handing, that a signal received from a wayside device was received and that a travel restriction represented by the signal was complied with by the vehicle system, or a content of a track warrant received by the operator.

6. The method of claim 1, wherein the context-sensitive action checklist is a first context-sensitive action checklist and is generated or selected based on one or more of: a geographic location of the vehicle system or a temporal duration since the operator last provided a response to a previous, second context-sensitive action checklist, wherein the first context-sensitive action checklist varies based on one or more of the geographic location of the vehicle system or a length of time since the operator last completed the second context-sensitive action checklist.

7. The method of claim 1, wherein the conditions in which the vehicle system is operating include one or more of a location of the vehicle system, a moving speed of the vehicle system, a throttle setting of the vehicle system, or a brake setting of the vehicle system.

8. The method of claim 1, wherein the alertness level of the operator that is determined indicates how alert the operator is while controlling movement of the vehicle system.

9. The method of claim 1, wherein the alertness level of the operator is determined by comparing one or more responses to the context-sensitive action checklist that are received via the input from the operator with one or more designated responses.

10. The method of claim 9, wherein the one or more designated responses are determined by one or more sensors.

11. The method of claim 1, wherein the request is a first request, the car is a first car, and the context-sensitive action checklist additionally includes a second request for the operator to confirm one or more handling requirements for a second car in the vehicle system that restrict one or more of a speed of the second car or a threshold distance that the second car must be kept from a propulsion-generating vehicle in the vehicle system.

12. An electronic job aid system, comprising:

one or more processors configured to be disposed onboard a vehicle system formed from one or more vehicles, the one or more processors configured to determine conditions in which the vehicle system is operating or will operate during movement of the vehicle system along one or more routes, the one or more processors also configured to generate or select a context-sensitive action checklist based on one or more of the conditions in which the vehicle system is operating or will operate, the context-sensitive action checklist generated or selected to include a request for an operator of the vehicle system to perform a calculation and provide a result of the calculation for one or more of (a) a deviation between the movement of the vehicle system and a trip plan that dictates planned operation of the vehicle system as a function of one or more of time, distance, or location along the one or more routes, (b) a difference between a planned amount of fuel to be consumed by the vehicle system and an actual amount of the fuel consumed by the vehicle system, (c) a difference between an actual throttle setting of the vehicle system and a planned throttle setting of the trip plan, (d) an inter-car force of the vehicle system, or (e) an amount of weight that a car of the vehicle system is overweight or underweight relative to a weight threshold, wherein the one or more processors are configured to present the context-sensitive action checklist to the operator of the vehicle system during the movement of the vehicle system, and to receive input from the operator of the vehicle system during the movement of the vehicle system and in response to one or more action items in the context-sensitive action checklist that is presented to the operator, the input from the operator including the result of the calculation from the request in the context-sensitive action checklist, wherein the one or more processors are configured to determine an alertness level of the operator of the vehicle system based on the result of the calculation that is received from the operator in response to the request for the calculation in the context-sensitive action checklist, and wherein the one or more processors also are configured to implement one or more alerting actions to increase the alertness level of the operator.

13. The system of claim 12, wherein the context-sensitive action checklist is presented on a first operating screen or a first gauge onboard the vehicle system, and wherein at least one of the action items in the context-sensitive action checklist additionally requests one or more of: information obtained from another, second operating screen or another, second gauge onboard the vehicle system, response from the operator that indicates performance of the vehicle system, or response from the operator that indicates one or more upcoming trip events that the vehicle system is heading toward along the one or more routes.

14. The system of claim 13, wherein at least one of the action items in the context-sensitive action checklist additionally requests the response from the operator that indicates one or more upcoming trip events that the vehicle system is heading toward along the one or more routes, the one or more upcoming trip events including one or more of: a change in speed limit of the one or more routes, an approach to a section of the one or more routes under maintenance, an approach to a crossing gate along the one or more routes, an approach to a crossing gate along the one or more routes, or an approach to an area restricted by one or more track warrants.

15. The system of claim 12, wherein the context-sensitive action checklist that is generated or selected additionally requests that the operator confirm one or more of the vehicle system is approaching a section of the one or more routes having a reduced speed restriction that previously was communicated to the operator via radio, requests that the operator confirm that the vehicle system includes a car carrying cargo requiring special handing, requests that the operator confirm that a signal received from a wayside device was received and that a travel restriction represented by the signal was complied with by the vehicle system, or requests that the operator confirms content of a track warrant received by the operator.

16. The system of claim 12, wherein the request is a first request, the car is a first car, and the context-sensitive action checklist additionally includes a second request for the operator to confirm one or more handling requirements for a second car in the vehicle system that restrict one or more of a speed of the car or a threshold distance that the second car must be kept from a propulsion-generating vehicle in the vehicle system.

17. An electronic job aid system, comprising:

one or more processors configured to be disposed onboard a vehicle system formed from one or more vehicles, the one or more processors configured to determine conditions in which the vehicle system is operating or will operate during movement of the vehicle system along one or more routes, the one or more processors also configured to generate or select a context-sensitive action checklist based on one or more of the conditions in which the vehicle system is operating or will operate, the context-sensitive action checklist generated or selected to include a request for an operator of the vehicle system to perform a calculation and provide a result of the calculation for one or more of (a) a deviation between the movement of the vehicle system and a trip plan that dictates planned operation of the vehicle system as a function of one or more of time, distance, or location along the one or more routes, (b) a difference between a planned amount of fuel to be consumed by the vehicle system and an actual amount of the fuel consumed by the vehicle system, (c) a difference between an actual throttle setting of the vehicle system and a planned throttle setting of the trip plan, (d) an inter-car force of the vehicle system, or (e) an amount of weight that a car of the vehicle system is overweight or underweight relative to a weight threshold, wherein the one or more processors are configured to present the context-sensitive action checklist to the operator of the vehicle system during the movement of the vehicle system, and to receive input from the operator of the vehicle system during the movement of the vehicle system and in response to one or more action items in the context-sensitive action checklist that is presented to the operator, the input from the operator including the result of the calculation from the request in the context-sensitive action checklist, wherein the one or more processors are configured to determine an alertness level of the operator of the vehicle system based on the result of the calculation that is received from the operator in response to the request for the calculation in the context-sensitive action checklist, wherein the one or more processors also are configured to determine that the conditions in which the vehicle system is operating include one or more of a location of the vehicle system, a moving speed of the vehicle system, a throttle setting of the vehicle system, or a brake setting of the vehicle system.

18. The system of claim 17, wherein the context-sensitive action checklist is a first context-sensitive action checklist that is generated or selected based on one or more of: a geographic location of the vehicle system or a temporal duration since the operator last provided a response to a previous, second context-sensitive action checklist, wherein the first context-sensitive action checklist varies based on one or more of the geographic location of the vehicle system or a length of time since the operator last completed the second context-sensitive action checklist.

19. The system of claim 17, wherein the alertness level of the operator that is determined by comparing the result of the calculation that was requested by the context-sensitive action checklist with one or more designated responses.

20. The system of claim 19, wherein the one or more processors are configured to determine the one or more designated responses for comparing with the result of the calculation provided by the operator based on output provided by one or more sensors.

* * * * *